US005618039A

United States Patent [19]

Tsai et al.

[11] Patent Number: 5,618,039

[45] Date of Patent: Apr. 8, 1997

[54] BATTING EXERCISING DEVICE FOR BASEBALL

[76] Inventors: Peter Tsai, 1F, No. 16, Shi-Jei St., Hsin-Chu City; Ching-Wen Chien, No. 11, Lane 6, Alley 379, Sec. 1, Fon-Shi Rd., FOn-Yuan City, Tai-Chung Hsien, both of Taiwan

[21] Appl. No.: 503,865

[22] Filed: Jul. 18, 1995

[51] Int. Cl.[6] ..... A63B 69/40

[52] U.S. Cl. ..... 473/423; 473/436

[58] Field of Search ..... 273/26 R, 26 E, 273/29 A, 197 R, 198 A, 200 R

[56] References Cited

U.S. PATENT DOCUMENTS

| | | | |
|---|---|---|---|
| 3,663,018 | 5/1972 | O'Leary | 273/26 E |
| 4,105,203 | 8/1978 | Cho | 273/29 A |
| 4,555,110 | 11/1985 | Ping | 273/26 E |

*Primary Examiner*—Theatrice Brown
*Attorney, Agent, or Firm*—Larson and Taylor

[57] ABSTRACT

This invention relates to a batting exercising device for baseball, it includes a longitudinal axis, an adjustable tripod used to support the longitudinal axis, a V rack which can horizontally rotate around the longitudinal axis, and a ball-like component installed on the end of the V rack, in which a switch providing an elastic resistance to the V rack is installed between the engaging pans of the V rack, and the single-way controllers which provide frictional resistance to one rotating direction of the V rack are installed on the top and bottom of the engaging pans respectively. By constructing the above components, the elastic and frictional resistance of the switch and the one-way controller can decrease the rotation speed of the V rack for safety consideration when the V rack is driven to rotate clockwise or counter-clockwise by the ball-like component struck by the player.

18 Claims, 5 Drawing Sheets

BATTING EXERCISING DEVICE FOR BASEBALL

BACKGROUND OF THE INVENTION

This invention relates to a batting exercising device, in which the rotating speed of the V rack can be decreased after the ball is struck to drive the V rack to rotate, so the safety is guaranteed to the player.

DESCRIPTION OF THE PRIOR ART

The conventional exercising device longitudinally extends to form a column with a proper length from the base, the ball is placed at the top of the column, and a long connecting line is connected between the ball and the column. The ball can fly through a distance equal to the length of the connecting line when it is struck by the player.

Observing the above design, the longitudinal column is placed under the ball, if the hitting spot of the bat is too low, the damage to the column is possibly happened.

Moreover, when the ball is struck by the player and flies away, the exercising device is pulled to move or fall down by the ball, thus the exercising device must have a heavy base, but it is inconvenient for moving the exercising device with too heavy base.

Furthermore, when the ball is struck by the player and flies away, the ball will stop at the place far from the player, so it is needed to take the ball back again before next exercising, which is troublesome for the player.

Besides, when the player strikes the ball, the ball flies away with a very high speed and to an uncontrollable orientation within the range of the connecting line, so the safety must be paid more attention to.

According to the aforementioned design, from the structure, it is, basically, only suitable for the leisure hours.

SUMMARY OF THE INVENTION

In view of the above description, the inventor of the invention provides a new batting exercising device which includes a longitudinal axis, an adjustable tripod used to support the longitudinal axis, a V rack which can horizontally rotate around the longitudinal axis, and a ball-like component installed on the end of the V rack. A switch which provides an elastic resistance to the V rack is installed between the engaging parts of the V rack, and the single-way controllers which provide frictional resistance to one rotating direction of the V rack are installed on the top and bottom of the engaging parts respectively. By constructing the above components, the elastic and frictional resistances of the switch and the single-way controller can decrease the rotation speed of the V rack for safety consideration when the V rack is driven by the ball-like component struck by the player.

Furthermore, the V rack which is driven and rotates horizontally around the longitudinal axis can rotate inversely to the original place by the elasticity of the spring of the switch, thus the procedure of taking the ball back is omitted, which is very convenient for the player.

DETAILED DESCRIPTION OF THE PREFERRED EMBODIMENTS

Figure 1:
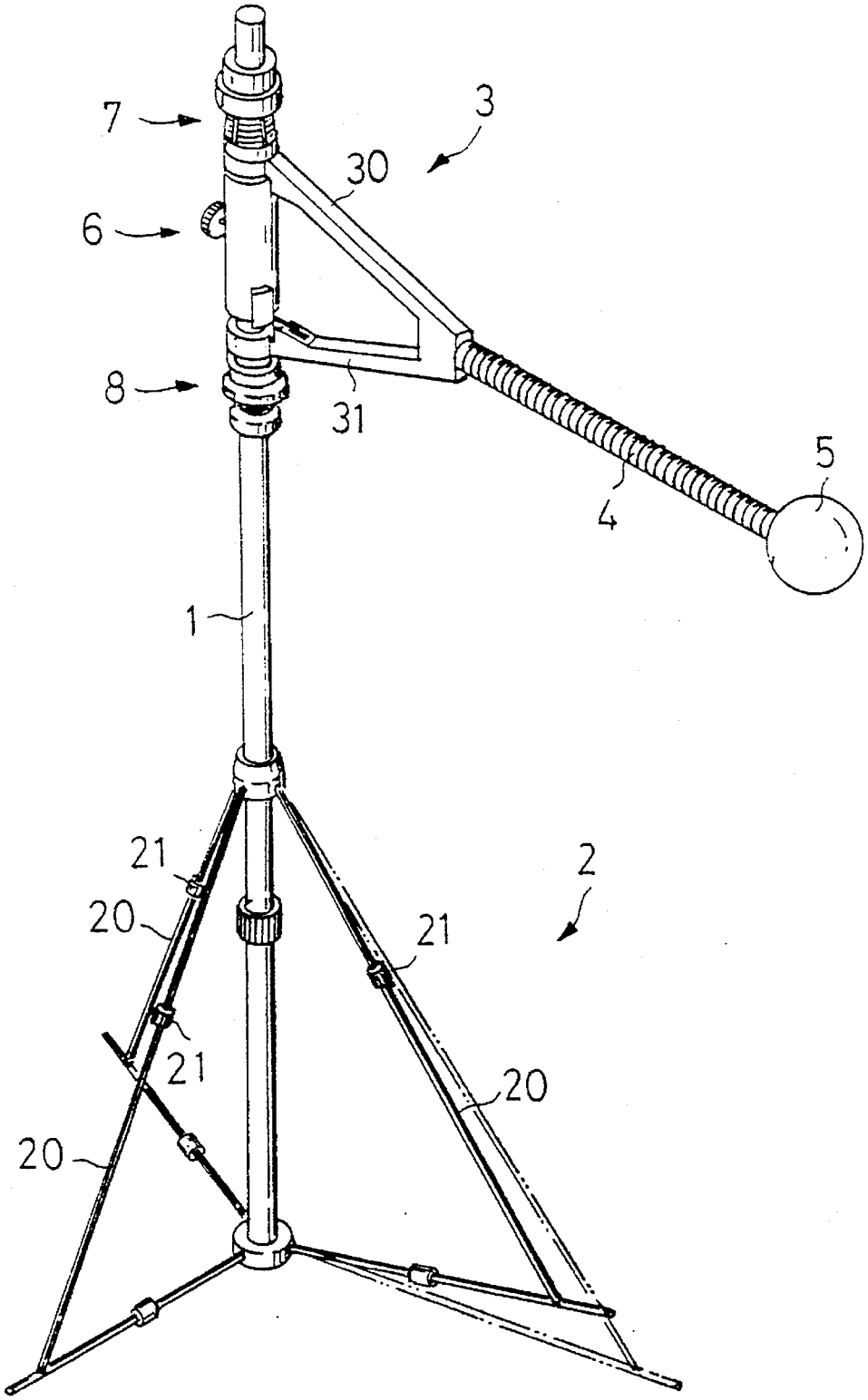
FIG. 1 is a perspective view of the invention.

As shown in FIG. 1, the exercising device includes a longitudinal axis (1), an adjustable tripod (2) used to support the longitudinal axis (1), a V rack (3) which can horizontally rotate around the longitudinal axis (1), and a ball-like component (5) installed on the end of the V rack (3).

Each prop (20) of the tripod (2) used to support the longitudinal axis (1) is retractile in length according to the adjusting ring (21) as the state shown in the dash line region of FIG. 1, thus even the tripod (2) is placed on the rough ground, the longitudinal axis (1) still can be fixed vertically by the tripod (2).

Figure 2:
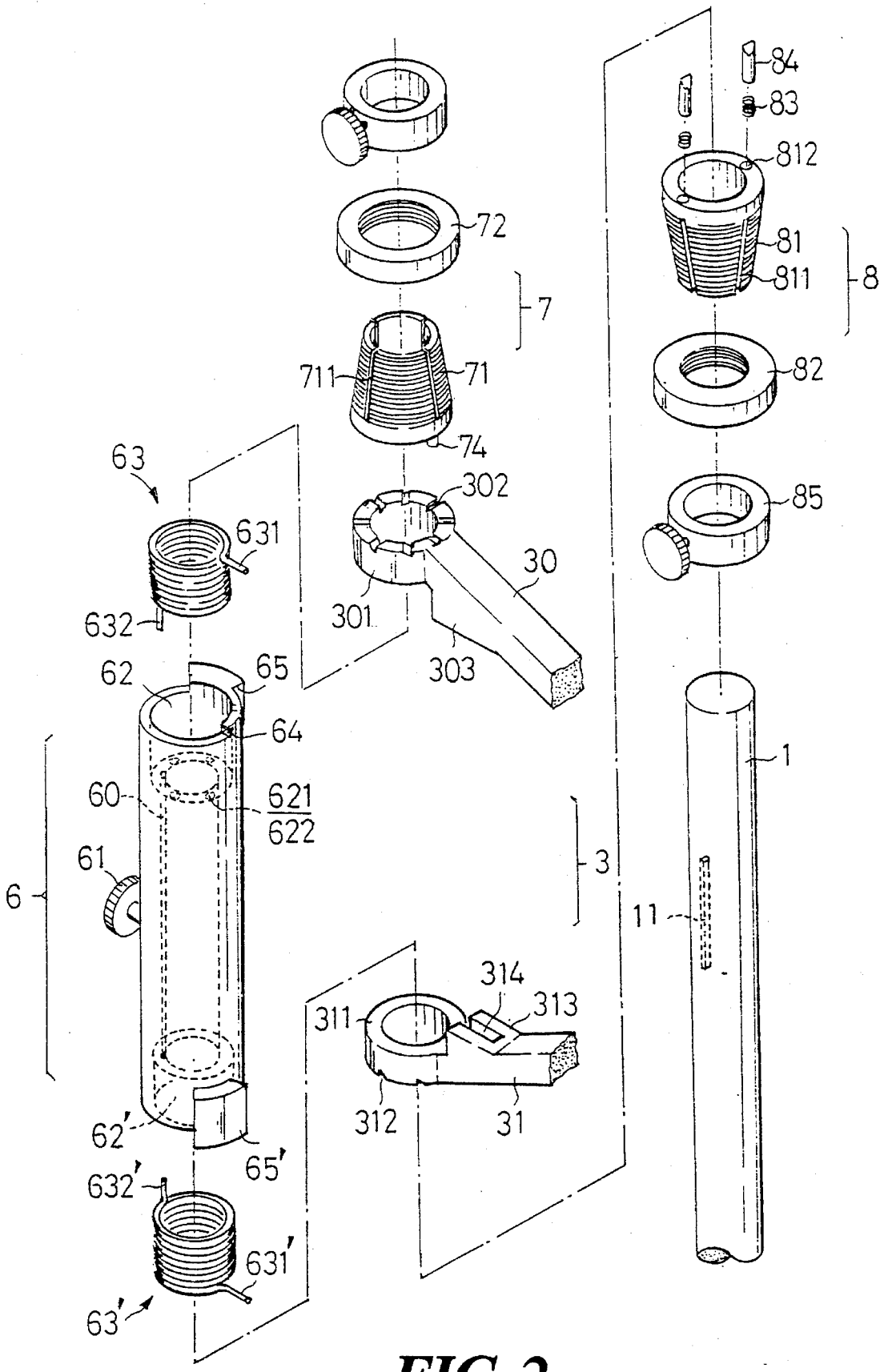
FIG. 2 is a perspective diagram showing the construction of the switch and the single-way controller.
Figure 3:
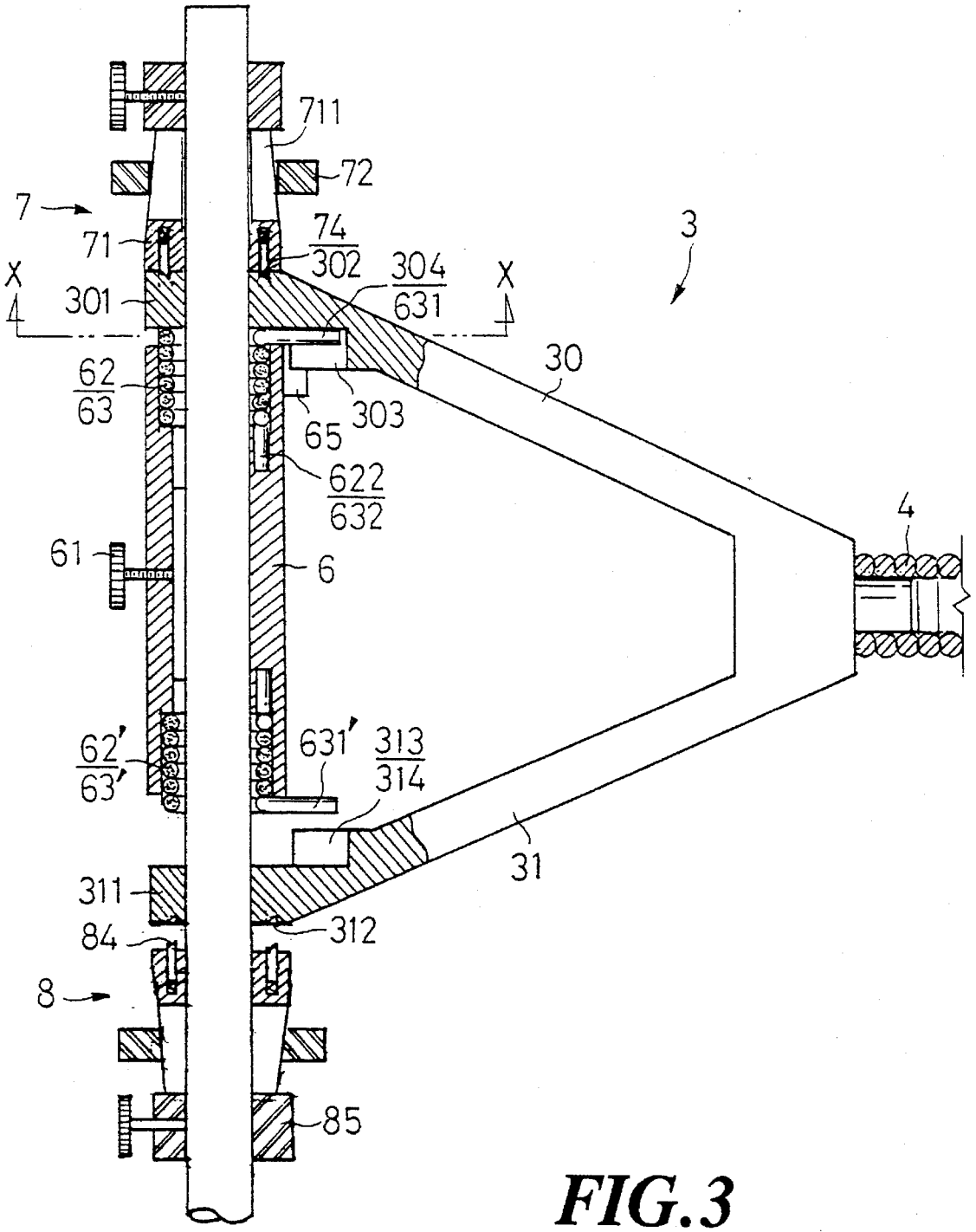
FIG. 3 is the enlarged sectional view of FIG. 1 indicating the switch on the top position.

The engaging parts (301, 311) are formed on the ends of the arms (30, 31) of the V rack (3) on the top of the longitudinal axis (1), as shown in FIGS. 2 and 3, respectively for engaging with the longitudinal axis (1). Because the structures of the arms (30, 31) and the engaging pans (301, 311) are the same, so only the detail descriptions of the arm (30) and the engaging part (301) are provided. A plurality of one-way teeth (302) are formed on the upper surface of the engaging pan (301), a convex part (303) is formed on the arm (30) near the engaging part (301), and a concave groove (304) is formed on the inner side of the convex part (303).

Because the engaging pans (301, 311) are engaged with the longitudinal axis (1), the V rack (3) can rotate horizontally around the longitudinal axis (1). Furthermore, an elastic stick (4) made by spring or rubber is installed on the V rack (3), a ball-like component (5) is installed on the end of the elastic stick (4), and it also can rotate around the longitudinal axis (1) according to the V rack (3).

Besides, a tubular switch (6) is engaged with the longitudinal axis (1) at the place between the engaging parts (301, 311) of the V rack (3), its length is smaller than the distance between the engaging parts (301, 311). The key slot (60) formed on the inner wall of the switch (6) is used to match with the respective slide key (11) of the longitudinal axis (1), thus the switch (6) can slide upwards and downwards along the longitudinal axis (1). A screw (61) is installed on the outer wall of the switch (6) at the position with respect to the key slot (60), it is used to adjust and locate the switch (6).

The expand regions (62) the inner diameter of which is larger than that of the switch (6) and capable of being engaged with the spring (63) are formed on the top and bottom of the switch (6) respectively. A sectional difference is formed between the inner walls of the expand region (62) and the switch (6), the adjusting hole (622) is formed on it, and an elasticity control part (64) which is axially convex is formed on the upper edge of the expand region (62) at the position with respect to the concave groove (304) of the V rack (3), besides, the stop part (65) is formed on the outer wall of the switch (6) at the position with respect to the side of the convex part (303) of the V rack.

The lateral end (631) of the spring (63) engaged in the expand region (62) of the switch is extended and perpendicular to the axial direction, on the other hand, the longitudinal end (632) is parallel to the axial direction. When the spring (63) is placed in the expand region (62), the longitudinal end (632) is inserted into the adjusting hole (622) on the sectional difference (621), and the lateral end (631) have contact with the elasticity control part (64).

Figure 4:
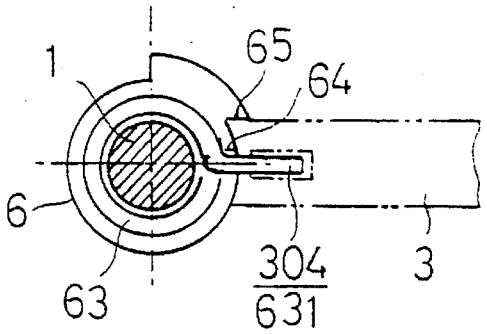
FIG. 4 is the X—X sectional diagram of FIG. 3 indicating the respective position of the V rack and the lateral face of the spring on the top of the switch under normal condition.
Figure 5:
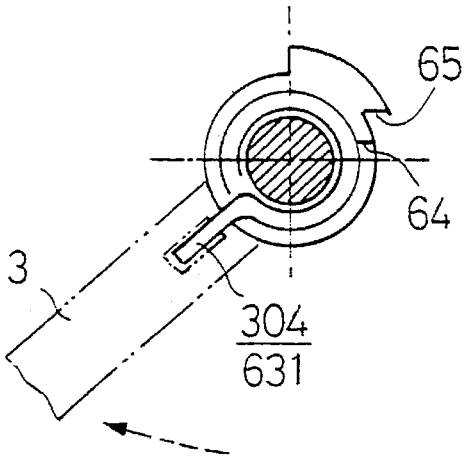
FIG. 5 is a diagram showing the spring of the switch in FIG. 4 synchronously driven by the clockwise rotating V rack.

When the switch (6) is adjusted and located on the upper location, the lateral end (631) of the spring (63) is pushed into the concave groove (304) of the V rack as shown in FIGS. 3 and 4. According to the above description, the V rack (3) is driven to rotate horizontally around the longitudinal axis (1) when the ball-like component (5) is struck by the player. FIG. 5 is an embodiment indicating the clockwise rotation of the V rack (3). The lateral end (631) of the spring (63) is driven synchronously by the concave groove (304) when the V rack (3) is rotating, so the spring (63) provides an inverse elasticity to the rotating V rack (3), in other words, it provides an elastic resistance to the rotation of the V rack (3), and the rotation speed of the V rack (3) is decreased by this resistance.

Figure 6:
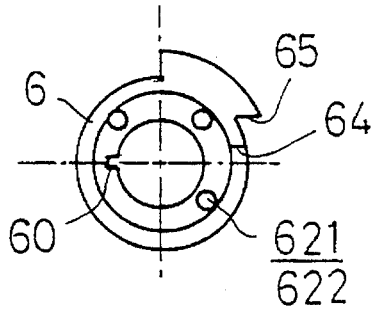
FIG. 6 is the top view of the switch showing the elastic adjusting hole used to adjust the elasticity of the spring.

Considering the elastic fatigue of the spring (63) after being used for a long time or the existing inverse elasticity under normal condition, in fact, there can be many adjusting holes (622) on the sectional difference (621) of the expand region (62) as shown in FIG. 6, then the elasticity of the spring (63) to the V rack (3) can be properly controlled by adjusting the respective position of the longitudinal end (632) of the spring to the adjusting hole (622).

For enhancing the resistance to the rotation of the V rack (3), the single-way controllers (7, 8) are installed on the top and bottom of the engaging parts (301, 311) respectively. The single-way controller (7) includes a chucking ferrule (71) which is engaged with the longitudinal axis (1) and an adjusting ring (72) used to screw the ferrule. The thread portion of the adjusting ring (72) of the chucking ferrule (71) is a declining surface, a plurality of cutting slots (711) are axially formed on this surface, thus the inner diameter of the chucking ferrule (71) is getting small by the compression of the adjusting ring (72) when the chucking ferrule (71) is screwing with the adjusting ring (72).

Furthermore, the engaging hole (712) used for the engagement of the spring (73) and the retractile tooth (74) is formed on the bottom surface of the chucking ferrule (71), the retractile tooth (74) is on the position with respect to the one-way tooth (302) of the engaging part (301) of the V rack, thus the single-way controller (7) can be driven to rotate synchronously by the one-way tooth (302) of the engaging part (301) through the retractile tooth (74). But the one-way tooth (302) of the engaging part (301) can not drive the single-way controller (7) to rotate through the retractile tooth (74) when the V rack is rotated inversely, so the single-way controller (7) stays where it is. In this embodiment, the one-way tooth (302) is set to drive the single-way controller (7) to synchronously rotate when the V rack (3) is rotated clockwise.

When the ball-like component (5) is struck by the player, the switch (6) provides an elastic resistance to the clockwise rotating V rack (3), besides, the single-way controller (7) also provides a frictional resistance to the clockwise rotating V rack (3) by properly setting the adjusting ring (72), which largely decreases the rotating speed of the V rack (3) for safety consideration.

When the inertia of the clockwise driven V rack (3) reaches balance to the aforementioned elastic and friction resistance, the V rack (3) is automatically and inversely rotated by the inverse elasticity of the spring (63) of the switch (the single-way controller (7) is useless this time). When the stop part (65) of the switch (6) contacts the convex part (303) on the side of the V rack, the rotation of the V rack (3) is limited, and the V rack (3) is on the beginning condition, in other words, the ball-like component (5) automatically returns to the original place.

When the ball-like component (5) is located on the upper position as shown in FIG. 3, the V rack (3) is supported by the switch (6) and controlled by the single-way controller (7) and the spring (63) of the switch (6) for achieving the aforementioned movements. The single-way controller (8) on the bottom of the engaging part (311) of the V rack is supported by the locating ring (85) at the position away from the one-way tooth (312) formed on the bottom surface of the engaging part (311) of the V rack a distance when the switch (6) is located on the upper position, so that the single-way controller (8) won't act at the same time with the single-way controller (7).

Figure 7:
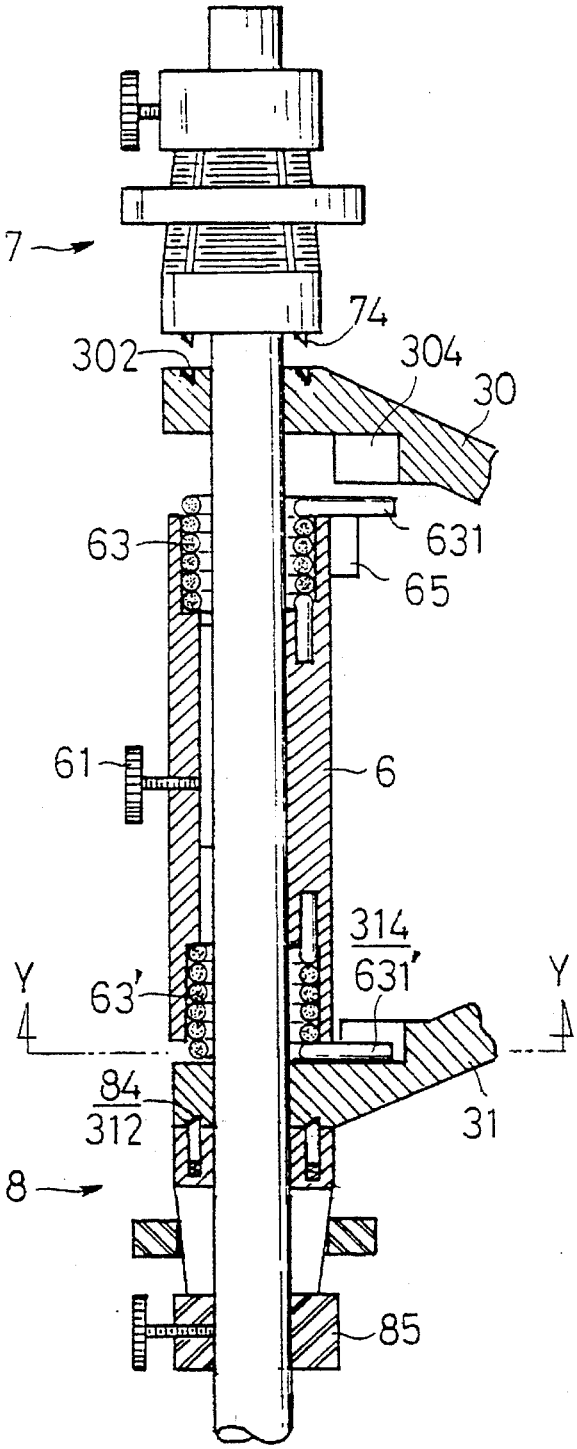
FIG. 7 is the enlarged diagram of FIG. 1 indicating the switch on the bottom position.
Figure 8:
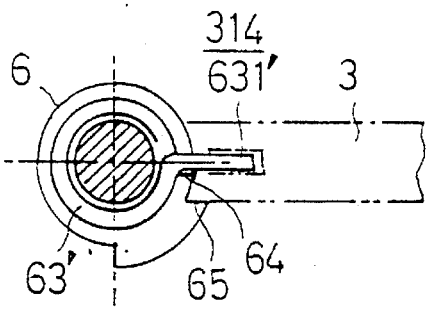
FIG. 8 is the Y—Y sectional view of FIG. 7 indicating the respective position of the V rack and the lateral face of the spring on the bottom of the switch under normal condition.

When the switch (6) is located on the upper position, the exercising device is suitable for the right hand batter (clockwise rotation), it is also adjustable for training the left hand batter (counterclockwise rotation). The V rack (3) can slide downwards to the position where the one-way tooth (312) formed on the bottom surface of the engaging part (311) of it have contact with the single-way controller (8) by removing the screw (61) on the outer wall of the switch (6), move the switch to the lower position between the engaging parts (301, 311) as shown in FIG. 7, and then the lateral end (631) of the spring on the bottom of the switch (6) enters the concave groove (314) of the convex part (313) of the V rack as shown in FIG. 8.

The retractile tooth (84) of the single-way controller (8) and the one-way tooth (312) of the engaging part (311) are designed toward opposite orientation with the retractile tooth (74) of the single-way controller (7) and the one-way tooth (302) of the engaging part (301). A locating ring (85) is installed on the longitudinal axis (1) below the above single-way controller (8), it is used for supporting the single-way controller (8) to remain its horizontal height.

Figure 9:
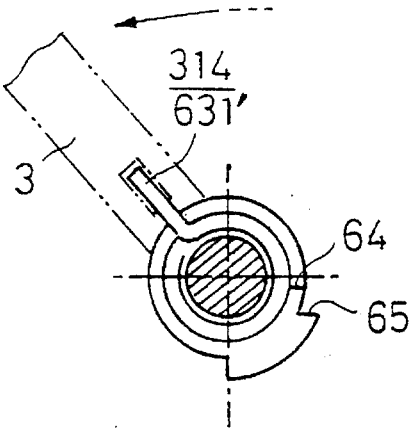
FIG. 9 is a diagram showing the spring of the switch in FIG. 8 synchronously driven by the counterclockwise rotating V rack.

When the ball-like component (5) is struck by the player, the switch (6) provides an elastic resistance to the counterclockwise rotating V rack (3) as shown in FIG. 9, besides, the single-way controller (8) also provides a frictional resistance to the counterclockwise rotating V rack (3) by properly setting the adjusting ring (82), which largely decreases the rotating speed of the V rack (3) for safety consideration.

The rotation of the V rack (3) in the above embodiment is limited by the elastic resistance of the switch (6) and the friction resistance of the single-way controller (8), of course, it is also useful by using only the elastic resistance of the switch (6) to limit the rotation of the V rack (3).

Moreover, the single-way controllers (7, 8) which provide frictional resistance to the V rack (3) are not limited to be the above structures, the usual single-way controlling device is also suitable in this invention.

We claim:

1. A batting exercising device including a longitudinal support having a vertical axis and an upper and lower portions;

a rack installed on the upper portion of said longitudinal support and capable of rotating around said longitudinal axis in either direction, said rack having two arms connected together at one ends thereof and each arm including means for mounting said rack to said support at the other end thereof, said mounting means being spaced apart from each other;

a ball component installed on the end of said rack;

a switch mounted on said longitudinal support for movement between an upper position and a lower position to alternatively engage said rack;

means for alternately locking said switch on said support in said upper and lower position; and a first spring and a second spring in said switch which provide elastic resistance to rotation of said rack said first spring resisting rotation of said rack against rotation in one direction when said switch is locked in said upper position, and said second spring resisting rotation of said rack against rotation in an opposite direction when said switch is locked in said lower position.

2. The exercising device as recited in claim 1, wherein said support comprises a tripod located at the bottom of said longitudinal axis, said tripod includes a plurality of props, each prop of said tripod comprised of telescoping legs and an adjusting ring that locks said legs together.

3. The exercising device as recited in claim 1, wherein said rack is connected with said ball component through a lateral elastic stick.

4. The exercising device as recited in claim 1, wherein a convex part having an inner side is formed on each arm of said rack near said mounting means, and a concave groove is formed on the inner side of said convex part.

5. The exercising device as recited in claim 4, wherein the aforementioned switch includes:

an outer wall;

expanded regions formed on a top portion and a bottom portion thereof and capable of being engaged with said springs;

an elasticity control part formed on an edge of each expanded region at the position with respect to said concave groove of said rack;

a plurality of adjusting holes formed on a sectional difference of said expand region; and a stop part formed on the outer wall of said switch at the position with respect to said convex part of said rack and capable of contacting with said convex part.

6. The exercising device as recited in claim 5, wherein said spring has a lateral ends, the lateral end of said spring arranged in said expanded region of said switch extending perpendicularly to the axial direction and contacts with said elasticity control part, said lateral end of said spring also enters said concave groove of said rack, on the other hand, a longitudinal end is extended in the axial direction and inserted in the adjusting hole on the sectional difference of said expanded region.

7. The exercising device as recited in claim 5, wherein said springs on the top and bottom of said switch, said elasticity control parts, and said stop parts permit rotation in the opposite directions.

8. The exercising device as recited in claim 5, wherein said switch is tubular and has an inner wall, a key slot is formed on the inner wall of said tubular switch, said key slot mating with a sliding key which is correspondingly located with respect to said longitudinal axis.

9. A batting exercising device including a longitudinal rod having a vertical axis and an upper and lower portions;

a rack installed on the upper position of said longitudinal rod and capable of rotating around said longitudinal axis in either direction, a ball component installed on the end of said rack;

a switch is mounted on said longitudinal rod for movement between an upper position and a lower position to alternately engage said rack;

a means for alternately locking said switch on said rod in said upper and lower positions;

a first spring and a second spring in said switch which provide elastic resistance to the two directional rotations of said rack said first spring resisting rotation of said rack against rotation in one direction when said switch is locked in said upper position, and said second spring resisting rotation of said rack in an opposite direction when said switch is locked in said lower position;

a plurality of one-way teeth formed on the outer edges of said mounting means of said rack;

a single-way controller which can provide frictional resistance to the rotation of said rack is formed on the outside of said mounting means of said rack; and when the switch is located in one of said upper and lower positions, said single-way controller on the other side is separated from said one-way teeth formed on the surface of said mounting means of said rack with respect to said single-way controller.

10. The exercising device as recited in claim 9, wherein said support comprises a tripod located at the bottom of said longitudinal axis, said tripod includes a plurality of props, each prop of said tripod comprised of telescoping legs and an adjusting ring that locks said legs together.

11. The exercising device as recited in claim 9, wherein said rack is connected with said ball component through a lateral elastic stick.

12. The exercising device as recited in claim 9, wherein a convex part having an inner side is formed on each arm of said rack near said mounting means, and a concave groove is formed on the inner side of said convex part.

13. The exercising device as recited in claim 12, wherein the aforementioned switch includes:

an outer wall;

expanded regions formed on a top portion and a bottom portion thereof and capable of being engaged with said springs;

an elasticity control part formed on an edge of each expanded region at the position with respect to said concave groove of said rack;

a plurality of adjusting holes formed on a sectional difference of said expand region; and a stop part formed on the outer wall of said switch at the position with respect to said convex part of said rack and capable of contacting with said convex part.

14. The exercising device as recited in claim 13, wherein said spring has a lateral end, the lateral end of said spring arranged in said expanded region of said switch extending perpendicularly to the axial direction and contacts with said elasticity control part, said lateral end of said spring also enters said concave groove of said rack, on the other hand, a longitudinal end is extended in the axial direction and inserted in the adjusting hole on the sectional difference of said expanded region.

15. The exercising device as recited in claim 13, wherein said springs on the top and bottom of said switch, said elasticity control parts, and said stop parts permit rotation in the opposite directions.

16. The exercising device as recited in claim 13, wherein said switch is tubular and has an inner wall, a key slot is formed on the inner wall of said tubular switch, said key slot mating with a sliding key which is correspondingly located with respect to said longitudinal axis.

17. The exercising device as recited in claim 9, wherein said single-way controller is characterized in that:

a chucking ferrule is engaged with said longitudinal axis and an adjusting ring is screwed on said chucking ferrule;

said adjusting ring of said chucking ferrule has a thread portion that is a declining surface, and a plurality of cutting holes are axially formed on said declining surface;

the engaging hole used for engaging with the retractile tooth if formed on the bottom surface of said chucking ferrule; and said retractile tooth is formed on the position with respect to said one-way tooth of said engaging part of said rack, and they are capable of engaging with each other.

18. The exercising device as recited in claim 9, wherein said single-way controller can only be driven in a single orientation by said one-way tooth of said V rack.

* * * * *